US010708689B2

(12) United States Patent
Anemüller et al.

(10) Patent No.: US 10,708,689 B2
(45) Date of Patent: Jul. 7, 2020

(54) REDUCING ACOUSTIC FEEDBACK OVER VARIABLE-DELAY PATHWAY

(71) Applicant: LogMeln, Inc., Boston, MA (US)

(72) Inventors: Carlotta Anemüller, Erlangen (DE); Florian Heese, Dresden (DE); Patrick Vicinus, Friedrichsdorf (DE)

(73) Assignee: LogMeln, Inc., Boston, MA (US)

( * ) Notice: Subject to any disclaimer, the term of this patent is extended or adjusted under 35 U.S.C. 154(b) by 0 days.

(21) Appl. No.: 16/412,863

(22) Filed: May 15, 2019

(65) Prior Publication Data

US 2019/0356984 A1 Nov. 21, 2019

Related U.S. Application Data

(60) Provisional application No. 62/672,031, filed on May 15, 2018.

(51) Int. Cl.
*H04R 3/02* (2006.01)
*H04R 3/04* (2006.01)

(52) U.S. Cl.
CPC ..... *H04R 3/02* (2013.01); *H04R 3/04* (2013.01)

(58) Field of Classification Search
CPC . H04R 3/02; H04R 3/04; H04R 3/005; H04R 25/453; H04R 25/554; H04R 27/00; H04R 2410/07; G10L 2021/02166; G10L 2021/02082; G10L 2021/02165; H04M 9/082; G11B 20/24
USPC ..... 381/93, 94.1, 83
See application file for complete search history.

(56) References Cited

U.S. PATENT DOCUMENTS

| | | | | |
|---|---|---|---|---|
| 8,477,956 | B2 * | 7/2013 | Ura | H04R 3/02 379/406.05 |
| 8,761,349 | B2 | 6/2014 | Winterstein | |
| 8,914,007 | B2 * | 12/2014 | Virolainen | H04M 3/567 379/202.01 |
| 9,443,528 | B2 * | 9/2016 | Li | H04B 3/23 |
| 10,032,475 | B2 * | 7/2018 | Prins | G11B 20/22 |
| 2007/0189507 | A1 * | 8/2007 | Tittle | H04M 9/082 379/406.01 |
| 2010/0177884 | A1 * | 7/2010 | Prakash | H04M 9/082 379/406.08 |

(Continued)

FOREIGN PATENT DOCUMENTS

| | | | |
|---|---|---|---|
| DE | 102014211271 | A1 | 11/2015 |
| WO | 2018059736 | A1 | 4/2018 |

OTHER PUBLICATIONS

S. Yamamoto et al; "The Echo Canceller Using the Fast Kalman Filter Algorithm"; IFAC Control Science and Technology (9th Triennial World Congress) Kyoto, Japan; 1981, 6 pages.

(Continued)

*Primary Examiner* — Ahmad F. Matar
*Assistant Examiner* — Sabrina Diaz
(74) *Attorney, Agent, or Firm* — BainwoodHuang

(57) ABSTRACT

A technique for reducing acoustic feedback in audio communications includes measuring variations in round-trip delay over an audio signal pathway. The technique varies a delay interval of an adjustable-delay element in real time based on the measured variations in round-trip delay, effectively canceling the delay variations. Further techniques are disclosed for detecting and eliminating howling frequencies which arise as a result of acoustic feedback in the audio signal pathway.

19 Claims, 7 Drawing Sheets

(56) References Cited

U.S. PATENT DOCUMENTS

| | | | | |
|---|---|---|---|---|
| 2011/0110532 | A1* | 5/2011 | Svendsen | H04M 9/082 381/93 |
| 2015/0043571 | A1* | 2/2015 | Rabipour | H04M 9/082 370/352 |
| 2015/0332704 | A1* | 11/2015 | Sun | H04M 9/082 704/227 |
| 2016/0050491 | A1* | 2/2016 | Ahgren | H04L 65/403 381/66 |
| 2018/0132038 | A1* | 5/2018 | Dickins | H04M 3/56 |
| 2018/0227414 | A1* | 8/2018 | Kim | H04M 3/002 |

OTHER PUBLICATIONS

Stefan Kuhl et al; "Kalman Filter Based System Identification Exploiting the Decorrelation Effects of Linear Prediction"; Institute of Communication Systems (IKS) RWTH Aachen University, Germany; 2017 IEEE; 5 pages.

Jae-Won Lee et al; "Detection of Howling Using Temporal Variations in Power Spectrum"; 4 pages. (Note: pages missing; printed what was available online).

* cited by examiner

REDUCING ACOUSTIC FEEDBACK OVER VARIABLE-DELAY PATHWAY

BACKGROUND

Audio communications commonly take place over computer networks, such as the Internet. For example, many computing applications provide audio chat, video chat, web conferencing, VOIP (Voice Over Internet Protocol), or the like, which enable persons to speak with one another online.

Some audio applications perform local echo cancelation. For instance, when received audio from a remote computer is played back by a local loudspeaker, the loudspeaker's audio may be recorded by the local microphone, causing an echo to be heard at the remote computer. Audio applications may cancel the echo using a process called "system identification." With system identification, an audio application configures an adaptive filter to mimic a frequency response of the local audio environment. The adaptive filter receives audio from the remote computer (the local playback signal, or "reference"). The adaptive filter produces a filtered version of the reference as an estimate for the echo, and the audio application subtracts the output of the adaptive filter from incoming audio received from a local microphone to effectively cancel the echo.

SUMMARY

Unfortunately, local echo cancelation does not address certain types of acoustic feedback. Consider, for example, a case in which first and second persons in the same room participate in an online audio discussion, via respective first and second computing devices. Other persons may also participate remotely. When the first person talks, the voice of the first person travels to the microphone of the first computing device and over a computer network to the second computing device, where it is played by the speakers of the second computing device.

The audio path does not always stop there, however. Rather, the voice of the first person may travel through the room and back to the microphone of the first computing device, creating acoustic feedback. Given that network delays may be on the order of hundreds of milliseconds, feedback from the speakers of the second computing device can produce annoying echo, which may repeat over time and dampen down only after considerable time. In some cases, the feedback may become unstable, resulting in so-called "howling frequencies," i.e., oscillations at frequencies where the feedback is unstable. Such howling frequencies may persist and even grow over time. One might stop the howling frequencies by muting the microphone of the first computing device. Likewise, one might stop or reduce the howling frequencies by reducing the volume of the speaker of the second computing device. In any case, and even if no howling frequencies are present, acoustic feedback can significantly impair user experience.

One might consider addressing acoustic feedback using the above-described echo cancelation. However, the first computing device does not have access to the signal being played back by the second computing device in the room. Thus, the first computing device has no reference that can be subtracted using conventional echo cancelation. Further, system identification used in conventional systems depends on the audio signal pathway remaining consistent over short time scales, and thus is unsuitable for audio signals carried over a computer network, where delays are variable, often random, and non-linear.

In contrast with prior approaches, an improved technique for reducing acoustic feedback in audio communications includes measuring variations in round-trip delay over an audio signal pathway from a microphone of a first computing device, over a network to a second computing device, and from a speaker of the second computing device back to the microphone of the first computing device via an acoustic medium between the speaker and the microphone. The technique further includes configuring a path emulator that includes an adjustable-delay element coupled in series with an adaptive filter. The path emulator receives a signal from the microphone and produces a prediction signal, which is subtracted from the microphone signal to produce a corrected audio signal. The technique varies a delay interval of the adjustable-delay element in real time based on the measured variations in round-trip delay. The adjustable-delay element effectively cancels delay variations, establishing substantially linear behavior and enabling the adaptive filter to operate as if the delays were constant.

Advantageously, the improved technique reduces or cancels the effects of acoustic feedback. The technique also improves user experience, as acoustic-feedback-induced echoes are reduced or eliminated automatically. Users can focus on their conversations and other activities, without having to reach for the mute button or speaker controls.

In some examples, the improved technique further includes detecting and reducing howling frequencies. In some examples, howling-frequency detection proceeds by generating a sequence of frequency transforms of a microphone output signal and examining corresponding frequency bins across the frequency transforms. By performing autocorrelation operations on sequences of same-bin frequency-transform magnitudes across the frequency transforms, the technique identifies howling frequencies as frequency bins that produce high autocorrelation values and high magnitudes. In addition, by noting delay values at which maximum autocorrelation values occur for detected howling frequencies, one can identify variations in delay over the network.

In some examples, detecting a howling frequency includes generating a frequency transform of the microphone output signal and detecting that power is concentrated in a narrow frequency band.

In some examples, determining delay over the network includes performing an autocorrelation operation in the time domain on the microphone output signal, which may be downsampled to reduce computational complexity. A maximum autocorrelation value then provides the desired network delay. According to some variants, confidence scores are computed for both detection of howling frequency and network delay, with both confidence scores together identifying a howling frequency with high reliability.

In some examples, network delay values obtained using any of the above-described approaches provide inputs for establishing delay settings of the adjustable-delay element. Thus, the same methods for detecting howling frequencies may be used as vehicles for providing measurements of variable delay through the network. The adjustable-delay element can then apply the variable-delay values to compensate for variable network delays and thereby enable the adaptive filter to operate as if network delays were constant.

In some examples, once one or more howling frequencies have been detected, the improved technique may take measures to reduce or eliminate them. For example, the technique may apply one or more notch filters in the audio signal pathway. The notch filters are configured to selectively attenuate the howling frequencies while selectively passing other frequencies. Attenuating howling frequencies helps not only to address their unpleasant and annoying effects, but also helps to linearize the dynamics of the audio pathway, so that the adaptive filter may operate more effectively.

In some examples, detection and reduction of howling frequencies takes place independently of corrections for variable delay. For example, howling frequencies may be present even in the absence of variable delay. The improved technique may thus address howling frequencies as an independent improvement, regardless of whether variable-delay correction is also addressed.

Certain embodiments are directed to a method of reducing acoustic feedback in audio communications. The method includes measuring changes in round-trip delay along an audio signal pathway that extends from a microphone of a first computing device, to a computer network, over the computer network to a second computing device, to a speaker of the second computing device, and through an acoustic medium from the speaker back to the microphone. The microphone has an output that produces a microphone signal. The method further includes modeling the audio signal pathway with a path emulator that includes (i) an adaptive filter configured to emulate an impulse response of the audio signal pathway but not the changes in round-trip delay and (ii) an adjustable-delay element, coupled in series with the adaptive filter and configured to emulate the changes in round-trip delay based on the measured changes. The method still further includes generating, by the path emulator in response to receipt of an audio signal by the path emulator, a prediction signal that emulates effects of the audio signal pathway on the audio signal, the audio signal generated as a difference between the microphone signal and the prediction signal and providing a representation of the microphone signal corrected for acoustic feedback.

Other embodiments are directed to a computerized apparatus constructed and arranged to perform a method of reducing acoustic feedback in audio communications, such as the method described above. Still other embodiments are directed to a computer program product. The computer program product stores instructions which, when executed on control circuitry of a computerized apparatus, cause the computerized apparatus to perform a method of reducing acoustic feedback in audio communications, such as the method described above.

The foregoing summary is presented for illustrative purposes to assist the reader in readily grasping example features presented herein; however, the foregoing summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments of the invention, as illustrated in the accompanying drawings, in which like reference characters refer to the same or similar parts throughout the different views. The drawings are not necessarily to scale, emphasis instead being placed upon illustrating the principles of various embodiments.

DETAILED DESCRIPTION OF THE INVENTION

Embodiments of the invention will now be described. It should be appreciated that such embodiments are provided by way of example to illustrate certain features and principles of the invention but that the invention hereof is not limited to the particular embodiments described.

An improved technique for reducing acoustic feedback in audio communications includes measuring variations in round-trip delay over an audio signal pathway and applying the measured delay variations to an adjustable-delay element coupled in series with an adaptive filter. Together, the adjustable-delay element and the adaptive filter emulate behavior of the audio signal pathway, including variations in network delays, and thereby enable reduction or cancelation of acoustic feedback.

Figure 1:
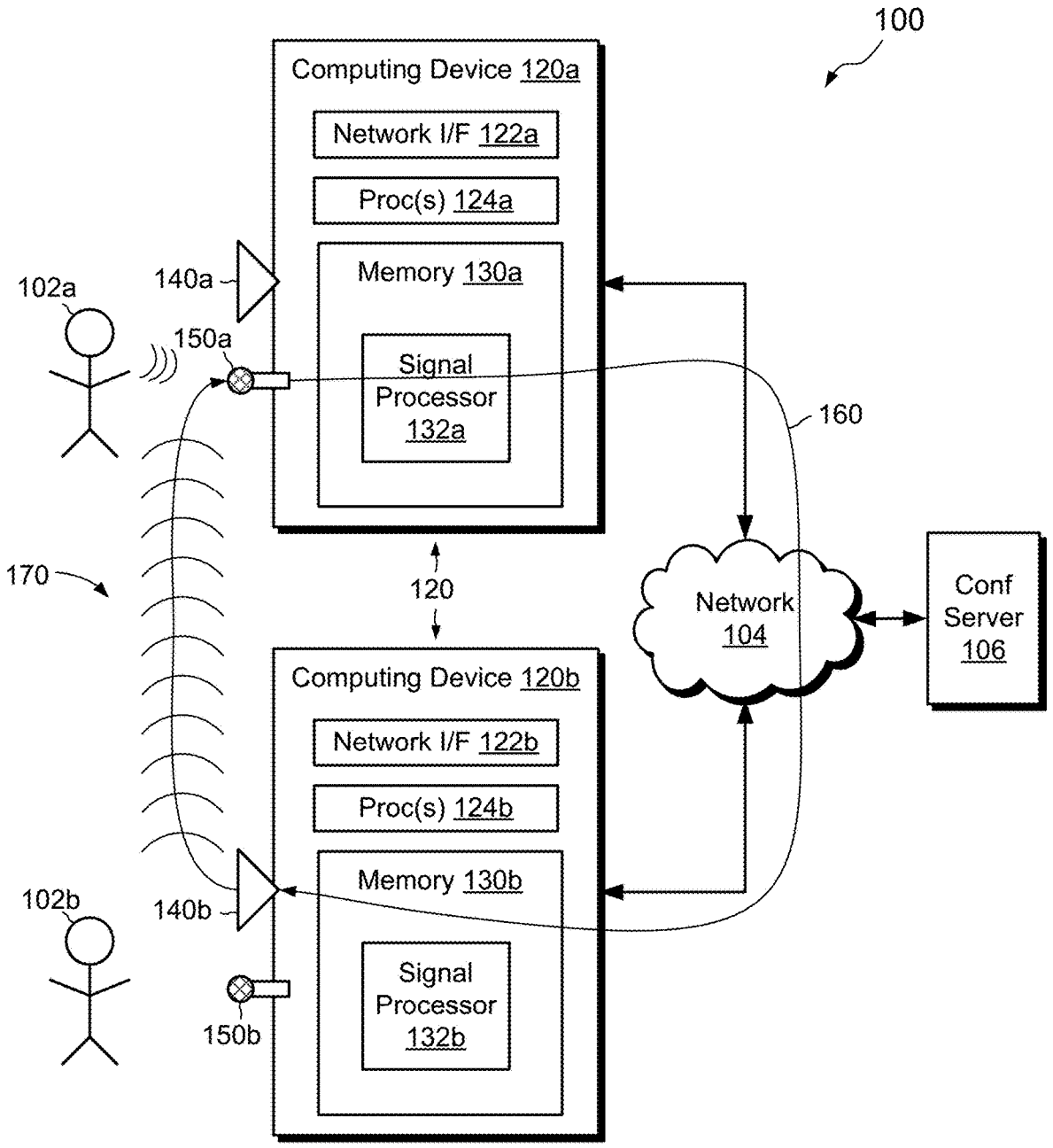
FIG. 1 is block diagram of an example environment in which embodiments of the invention hereof can be practiced.

FIG. 1 shows an example environment 100 in which embodiments of the improved technique can be practiced. Here, first and second computing devices 120*a* and 120*b* are located in the same physical space or room. A first user 102*a* operates the first computing device 120*a*, and a second user 102*b* operates the second computing device 120*b*. The first and second computing devices 120 are each connected to a network 104, such as a local area network (LAN), a wide area network (WAN), the Internet, or some other network or combination of networks. For example, the computing devices 120 each connect to a LAN within the room or space, e.g., using wired and/or wireless connections, and the LAN is connected via a router (not shown) to the Internet. The computing devices 120 may participate in audio communications, such as a web conference, audio chat, video chat, VOIP call, or the like. For example, each of the computing devices 120 runs web conferencing software (not shown), which is configured to process, send, and receive audio and video signals to other web conference participants. In some examples, a conference server 106 also connects to the network 104 and controls communication among participants. Although only two computing devices 120 are shown, one should appreciate that audio communications may involve any number of participants, some of whom may be local to one another and others of whom may be remote.

The computing devices 120 may be realized in the form of any electronic device or machine that is capable of processing audio signals, connecting to (or including) a microphone and speakers (or a headset), and communicating over a network. Non-limiting examples of suitable computing devices 120 include desktop computers, laptop computers, workstations, smart phones, PDAs (personal data assistants), electronic readers, set top boxes, gaming systems, and the like. There is no need for the computing devices 120 to be the same. For example, the computing device 120*a* might be a smart phone while the computing device 120*b* might be a laptop. Each computing device 120 has (or connects to) a microphone 150*a* or 150*b* and one or more speakers 140*a* or 140*b*.

As further shown in FIG. 1, each computing device 120 includes a network interface 122*a* or 122*b*, such as a Wi-Fi and/or Ethernet interface, a set of processors 124*a* or 124*b*, such as one or more processing chips or assemblies, and memory 130*a* or 130*b*, which may include random-access memory (RAM) as well as non-volatile memory, such as one or more disk drives, solid state drives, or the like. The set of processors 124*a* or 124*b* and the memory 130*a* or 130*b* of each computing device 120 form control circuitry, which is constructed and arranged to carry out various methods and functions as described herein. Also, the memory 130*a* or 130*b* of each computing device 120 includes a variety of software constructs realized in the form of executable instructions. When the executable instructions are run by the respective set of processors, the set of processors carry out the operations of the software constructs. Although certain software constructs are specifically shown and described, it is understood that each memory typically includes many other software constructs, which are not shown, such as an operating system, various applications, processes, and daemons.

As further shown in FIG. 1, each memory 130*a* or 130*b* "includes," i.e., realizes by execution of software instructions, a signal processor 132*a* or 132*b*. As will be described, each signal processor 132 may be configured to correct for acoustic feedback.

In example operation, the first and second users 102*a* and 102*b* operate their respective computing devices 120*a* and 120*b* to participate in an audio communication, such as a web conference, audio chat, or the like. When the first user 102*a* speaks, sound from the first user's voice reaches the microphone 150*a*, which converts sound waves in the air to electronic signals. For instance, the microphone 150*a* produces an analog output signal, which varies over time in a manner the tracks variations in the sound impinging on the microphone 150*a*. Circuitry within or coupled to the microphone 150*a* converts the analog signal to a corresponding sequence of digital codes, such as 16-bit binary values. The circuitry may sample the analog output of the microphone 150*a* at a constant sampling rate, such as 44 kHz, such that the microphone 150*a* produces a new 16-bit value approximately every 23 microseconds. The sequence of digital codes may be processed locally, by signal processor 132*a*, and sent out as a digital signal to the network 104.

From there, the digital signal travels over the network 104 to other participants in the communication, such as computing device 120*b*. Signal processor 132*b* in the computing device 120*b*, as well as associated hardware, process the incoming digital signal, e.g., by converting it back to analog form, amplify the analog signal, and output the analog signal to the speaker 140*b*, such that the user 102*b* can hear the sound produced by the user 102*a*. The reverse sequence can happen, as well, with the second user 102*b* speaking and the first user 102*a* listening, but here we focus on only one direction, to demonstrate the particular challenges involved.

When the speaker 140*b* of computing device 120*b* plays the audio signal received from the first user 102*a*, sound from the speaker 140*b* travels through an acoustic medium 170, e.g., air in the room, back to the microphone 150*a* of the first computing device 120*a*, thereby creating an acoustic feedback loop. As shown, the feedback loop follows an audio signal path 160 that includes the microphone 150*a*, the signal processor 132*a*, the network 104, the signal processor 132*b*, the speaker 140*b*, and the acoustic medium 170. One should appreciate that the acoustic medium 170 may be complex, as it typically includes room dynamics induced by reflections of sound from walls, ceilings, floors, and other objects.

Given that delays over the network 104 can be long, on the order of tens or hundreds of milliseconds, acoustic feedback can induce echoes which can take several seconds to dampen. Acoustic feedback can also produce howling frequencies—loud ringing at frequencies where the feedback becomes unstable. Also, given that delays over the network are variable, feedback-induced artifacts cannot easily be addressed using conventional, linear techniques.

Figure 2:
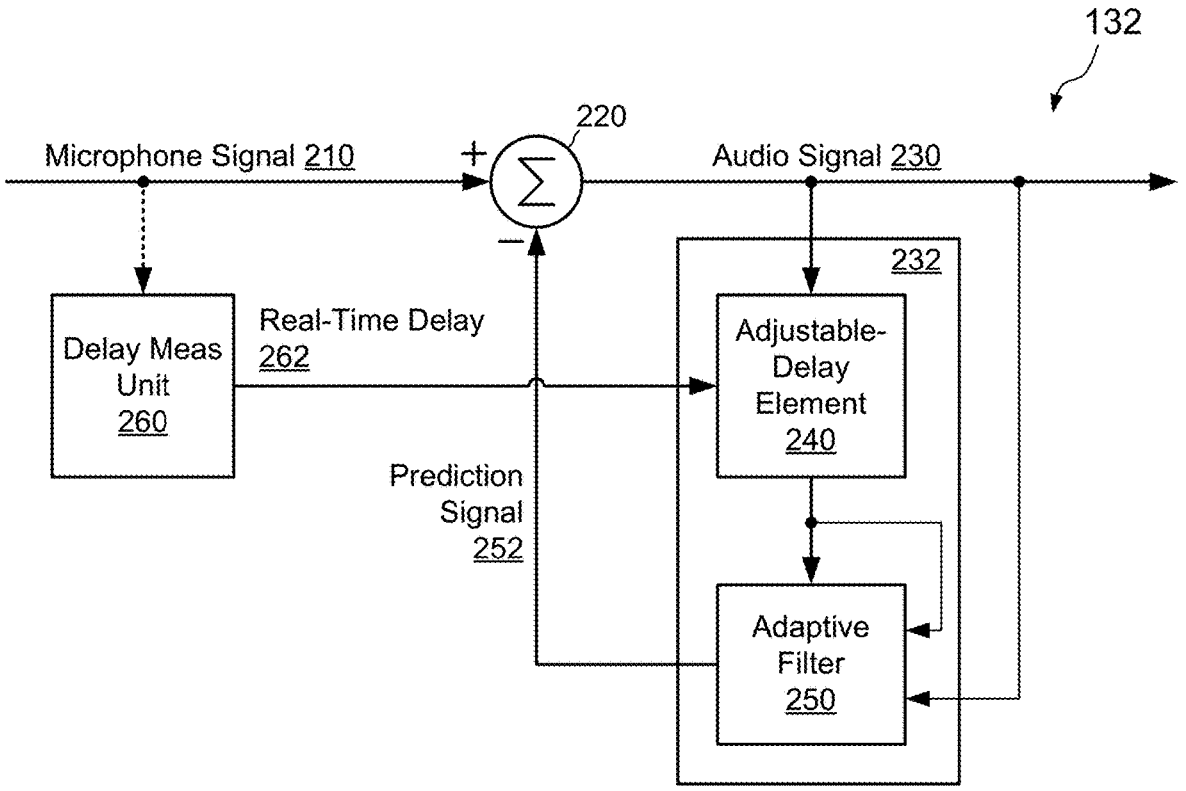
FIG. 2 is a block diagram showing an example signal processor of FIG. 1 in additional detail.

FIG. 2 shows portions of signal processor 132 in additional detail and illustrates an example approach to addressing variable delays. The signal processor 132 is intended to be representative of signal processors 132*a* and 132*b* of FIG. 1. As shown, signal processor 132 includes a summer 220, a path emulator 232, and a delay measurement unit 260. The path emulator 232 includes an adjustable delay element 240 and an adaptive filter 250.

In example operation, the signal processor 132 receives a microphone signal 210 from the microphone 150*a* (FIG. 1). Delay measurement unit 260 measures delays along the pathway 160, or along variable portions thereof, and produces respective real-time delay values 262. The real-time delay values 262 represent actual measurements of delay, including, in some examples, any variations in delay arising from jitter in the network 104. Preferably, the delay measurement unit 260 generates delay measurements based on features detected in the microphone signal 210, but this is not required. Alternatively, delay may be measured in other ways, such as by monitoring timestamps in network packets, for example.

The microphone signal 210 propagates to the summer 220, which produces an audio signal 230 by subtracting a prediction signal 252 from the microphone signal 210. The audio signal 230 then propagates to the network 104, where it gets distributed to other participants in the audio communication. Internally, adjustable delay element 240 delays the audio signal 230 by an amount of time based on a current value of the real-time delay 262, and adaptive filter 250 processes the delayed version of the audio signal 230 using adaptive, linear techniques. Such techniques may be similar to those used for performing system identification in devices that perform echo cancellation.

In some examples, the delay measurement unit 260 measures delay along the pathway 160 at a high rate, such as once per sample of the microphone signal 210 (e.g., at 44 kHz). The adjustable delay element 240 is preferably configured to respond quickly to changes in real-time delay 262, so as to track changes in delay 262 by updating its internal delay to match them. It can thus be seen that the adjustable delay element 240 emulates delay variations along the pathway 160, i.e., by mimicking those delays in its processing of the audio signal 230. Any variations in delay along the pathway 160 are thus reflected in substantially equal variations in delay across the adjustable delay element 240.

As the adjustable delay element 240 performs the role of emulating delay variations, the adaptive filter 250 need not perform this role itself. Rather, the role of the adaptive filter 250 is to emulate the linear impulse response of the pathway 160, so as to process the delayed audio signal 230 in a manner that mimics the way the pathway 160 affects the sound.

The arrangement of FIG. 2 thus disentangles the non-linear effects of variable delay from the linear effects of acoustics and signal processing. The adjustable delay element 240 emulates the variable delay, while the adaptive filter 250 emulates the impulse response. This means that the adaptive filter 250 can operate as if delay along the pathway 160 were constant, performing its linear corrections to account for loop dynamics, while the adjustable delay element 240 handles the non-linear corrections of variable delay. In some examples, the adaptive filter 250 is implemented as a Kalman filter, although other linear filter designs may be used as alternatives.

One should appreciate that the prediction signal 252, which is output from the adaptive filter 250, emulates the overall effects of the pathway 160 on the audio signal 230, including both linear and non-linear effects. The prediction signal 252 thus represents the audio signal 230 as it would appear after traversing the pathway 160 and arriving back to the microphone 150*a*. Summer 220 subtracts the prediction signal 252 from the microphone signal 210, effectively canceling the acoustic feedback, such that the output of the summer 220 ideally includes only new input to the microphone 150*a*.

Figure 3:
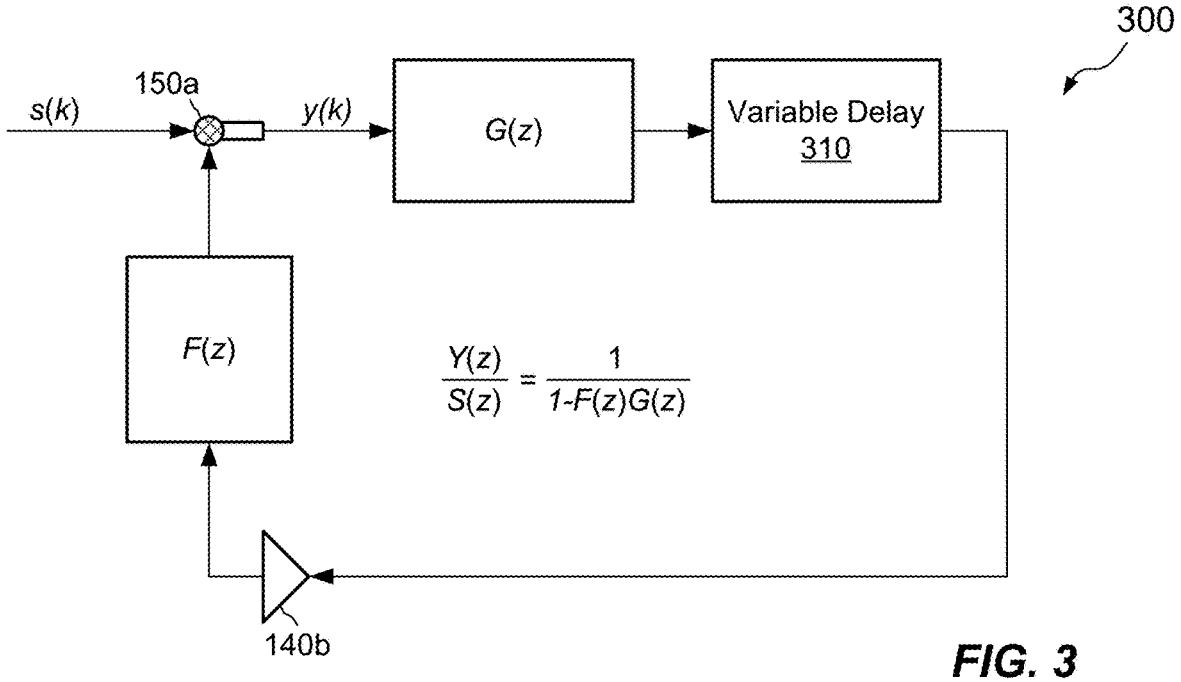
FIG. 3 is a simplified block diagram of the environment of FIG. 1 with a focus on feedback dynamics.

FIG. 3 shows an example, simplified view of feedback dynamics which may come into play in the environment 100 of FIG. 1. Here, a voice signal s(k) from the user 102*a* reaches the microphone 150*a*, which produces microphone signal y(k) (also labeled 210 in FIG. 2), which represents, in digital form, the analog output of the microphone ("k" is a sample index that corresponds to time). The signal y(k) may be altered by signal processors 132*a* and 132*b*, by microphone 150*a*, by speaker 140*b*, and by any other components in the pathway 160. Rather than modeling these components separately, we represent them collectively as a function G(z), where "z" is a complex, discrete-frequency variable. In addition, we represent the network 104 as a variable delay 310 and represent the acoustic medium 170 as function F(z).

With this arrangement, the closed-loop transfer function, which we define as a ratio of the microphone signal y(k) to the input signal s(k), may be expressed as follows:

$$\frac{Y(z)}{S(z)} = \frac{1}{1 - F(z)G(z)}. \quad \text{EQ. 1}$$

It can be seen from EQ. 1 that the feedback becomes unstable at frequencies where the magnitude of F(z)G(z) is greater than or equal to one. These frequencies are likely to be observed as howling frequencies.

Figure 4:
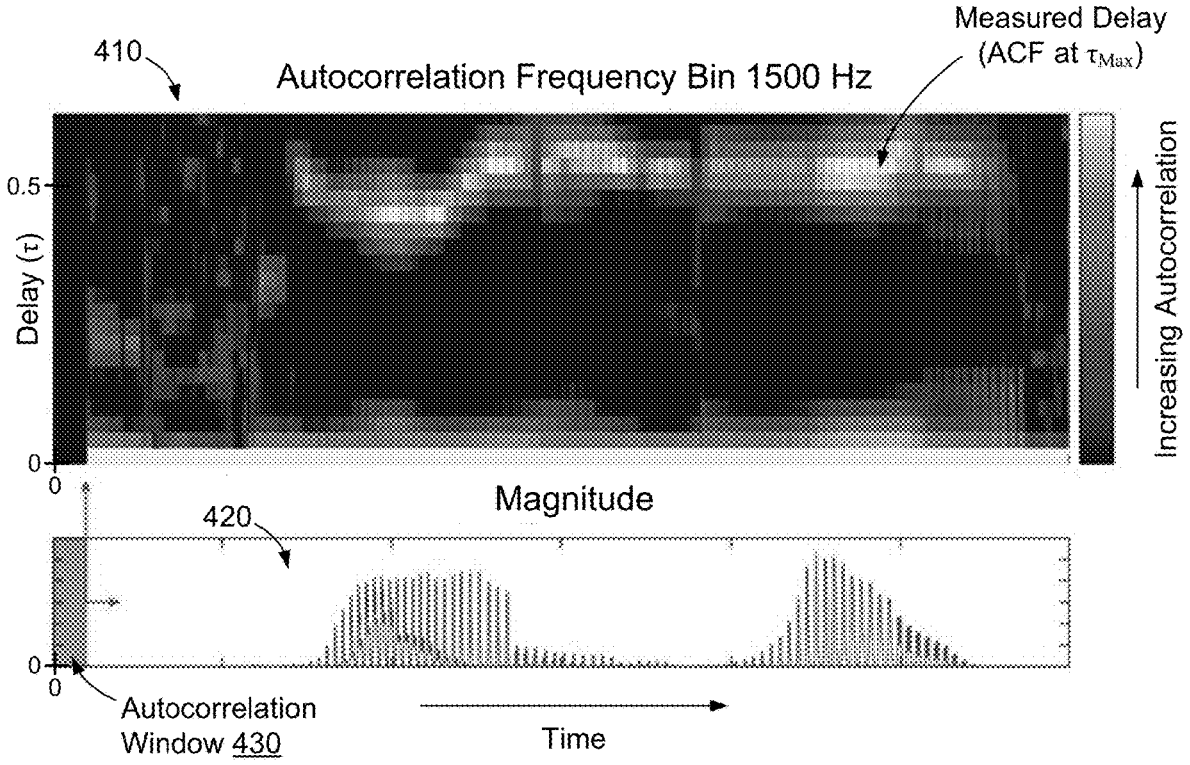
FIG. 4 shows example graphs of autocorrelation and magnitude of a microphone signal for a particular DFT bin observed across multiple DFTs over time.

FIG. 4 shows an example arrangement for detecting howling frequencies by performing autocorrelation operations on the microphone signal 210. The arrangement of FIG. 4 may also yield precise measurements of network delay.

The graphs shown in FIG. 4 depict results of performing a sequence of discrete Fourier transforms (DFTs) on the microphone signal 210. The top graph 410 shows autocorrelation results versus time, while the bottom graph 420 shows DFT magnitudes versus time. Both graphs depict results for a single frequency range, such as the range covered by a single DFT bin. The DFT bin in the example shown corresponds to a frequency of 1500 Hz, plus or minus 5 Hz. Thus, each magnitude value plotted on the graph 420 represents the value of the 1500-Hz bin of a respective DFT. Preferably, DFTs are generated at regular intervals, such as once every several milliseconds (e.g., once per video frame in a web conferencing application).

It can be seen from the magnitude graph 420 that DFT magnitude at 1500 Hz has strong peaks that persist over time. This strong content suggests that 1500 Hz may be a howling frequency. To confirm, one may compute autocorrelation results. Such results, as shown in graph 410, may be obtained by generating autocorrelations of the magnitudes in graph 420 over an autocorrelation window 430, which is advanced forward in time. For example, the signal processor 132 may compute an unbiased sample autocovariance as follows:

$$\hat{\gamma}(\tau) = \frac{1}{N-\tau}\sum_{m=1}^{N-\tau}(X(m)-\overline{X})(X(m+\tau)-\overline{X}), \quad \text{EQ. 2}$$

where "N" is the length of the window 430, X(m) is the magnitude value of the 1500-Hz bin of the DFT at index (e.g., frame index) m, $\overline{X}$ is the mean magnitude, and $\tau$ is a delay. Using EQ. 2, sample autocorrelation may be computed as follows:

$$\hat{\rho}(\tau) = \frac{\hat{\gamma}(\tau)}{\hat{\gamma}(0)}. \quad \text{EQ. 3}$$

It can thus be seen that, for each index m, which corresponds to a respective DFT, the autocorrelation $\hat{p}(\tau)$ specifies a respective function of $\tau$. Multiple such functions, for respecitve DFTs, can be seen in graph 410, where $\tau$ varies along the Y-axis and degree of autocorrelation is shown as brightness (a third dimension). Higher values of autocorrelation are shown as ligher shades of gray. It can be seen from FIG. 4 that autocorrelation peaks at about $\tau$=0.5, but varies somewhat over time due to variations in network delay.

As $\tau$ corresponds to time, a clear peak in autocorrelation indicates a repeating pattern in the microphone signal 210. The value of $\tau$ at that autocorrelation peak (i.e., $\tau_{Max}$) thus provides a round-trip delay along the pathway 160. In some examples, as will be described further, round-trip delays determined using autocorrelations provide real-time delays 262, which control the delay of the adjustable delay element 240 (FIG. 2).

Although FIG. 4 shows graphs 410 and 420 for illustrative purposes, one should appreciate that it is not necessary for the signal processor 132 to actually generate these graphs. Rather, the signal processor 132 may generate the magnitude and autocorrelation data only as needed to identify howling frequencies and to measure round-trip delays.

In some examples, the signal processor 132 can avoid having to compute autocorrelation results for all values of $\tau$. For instance, any measurement of round-trip delay may be used to define a bounding region within which to search for $\tau_{Max}$. This is the case regardless of whether round-trip delay is measured using autocorrelation, packet tracing, or any other approach. By limiting computations of autocorrelation to known regions, a great deal of unnecessary computation may be avoided.

Figure 5:
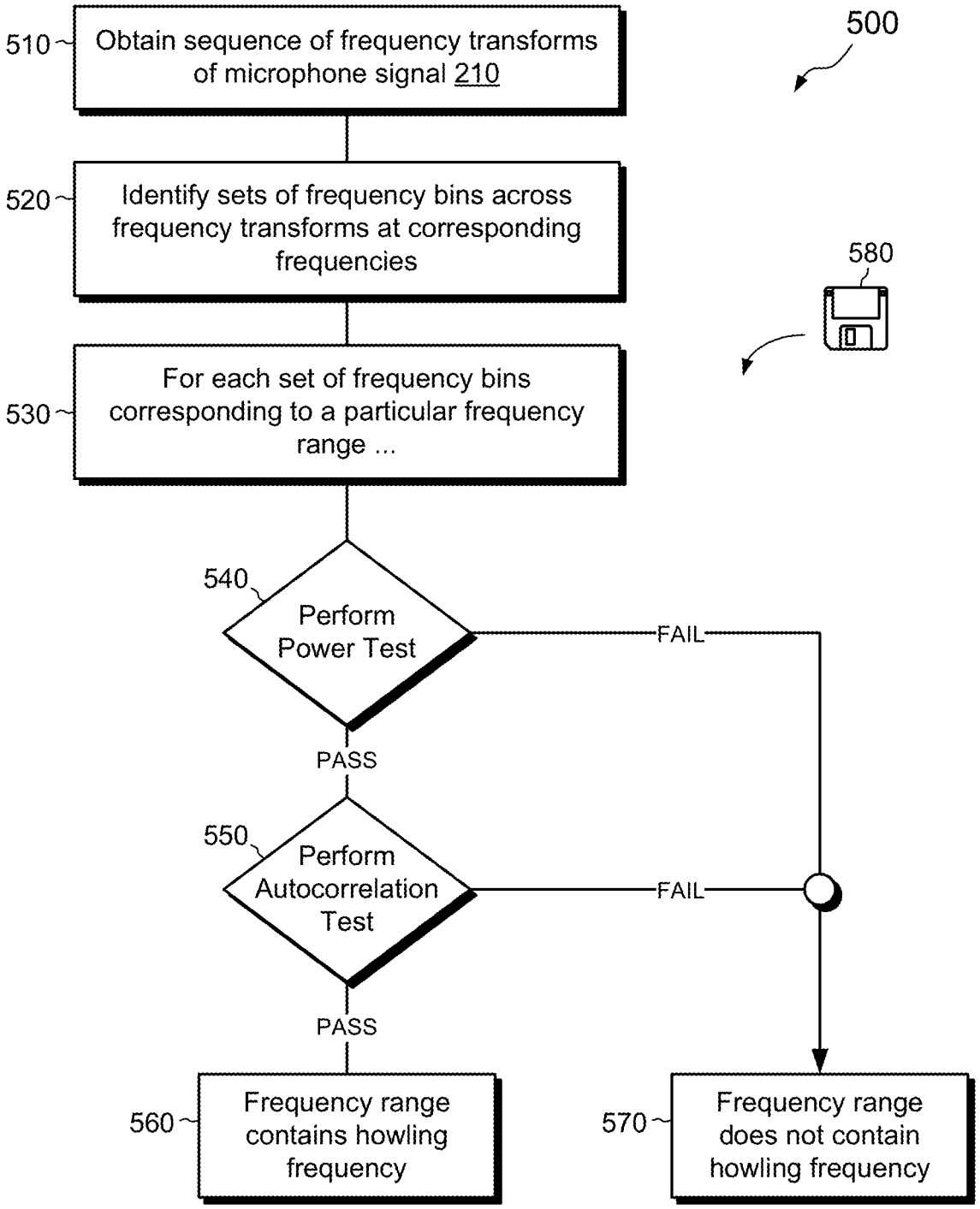
FIG. 5 is a flowchart showing an example method of detecting howling frequencies.

FIG. 5 shows an example method 500 for detecting howling frequencies. The method 500 may be performed in conjunction with feedback cancelation or independently. At 510, the signal processor 132 (or some other component)

obtains a sequence of DFTs of the microphone signal 210. For example, the signal processor 132 generates the DFTs once per video frame (when performing web conferencing), or on some other suitable basis, which is preferably periodic.

At 520, multiple sets of bins are identified at corresponding frequencies across the sequence of DFTs. For example, the signal processor 132 may identify one set of bins across all DFTs at 1500 Hz (as shown in FIG. 4), another set of bins across all DFTs at 1510 Hz, another set of bins across all DFTs at 1520 Hz, and so on. At 530, particular operations are performed on each set of bins, e.g., for each DFT frequency.

At 540, a power test is performed to determine whether DFT magnitude values in the current set of bins (at the current frequency) are large enough to merit consideration as a howling frequency. For example, the signal processor 132 may calculate a peak-to-average power ratio (PAPR) as follows:

$$PAPR(\omega_i) = 10\log_{10}\frac{|Y(\omega_i)|^2}{P_y}, \quad \text{EQ. 4}$$

where $$P_y = \frac{1}{M}\sum_{k=0}^{M-1}|Y(\omega_k)|^2 \quad \text{EQ. 5}$$

The power test at 540 passes if PAPR>$PAPR_{thresh}$, where $PAPR_{thresh}$ is a predetermined PAPR threshold. The power test fails otherwise.

At 550, assuming the power test passes, an autocorrelation test is performed. The autocorrelation test determines whether $\hat{\gamma}(\tau_{max})>\hat{\gamma}_{thresh}$, where $\hat{\gamma}_{thresh}$ is a predetermined autocorrelation threshold.

If both tests 540 and 550 pass, the signal processor 132 identifies the current frequency range (e.g., DFT bin) as containing a howling frequency (step 560). If either test fails, the signal processor 132 concludes that the current frequency range does not contain a howling frequency. The steps 540-570 may be repeated for each frequency range, i.e., for each bin, until all bins have been tested. The repetition of steps 540-570 may be carried out sequentially, in parallel, or in any suitable way.

One should appreciate that it may not be required to test every single bin for howling frequencies. For example, adjacent bins may be combined to reduce workload.

Preferably, the signal processor 132 performs the power test 540 prior to performing the autocorrelation test 550, as the power test is simpler and less computationally intensive. Thus, for example, a frequency bin can be quickly ruled out if it fails to meet the power test, avoiding the need for performing the more computationally expensive autocorrelation test.

Figure 6:
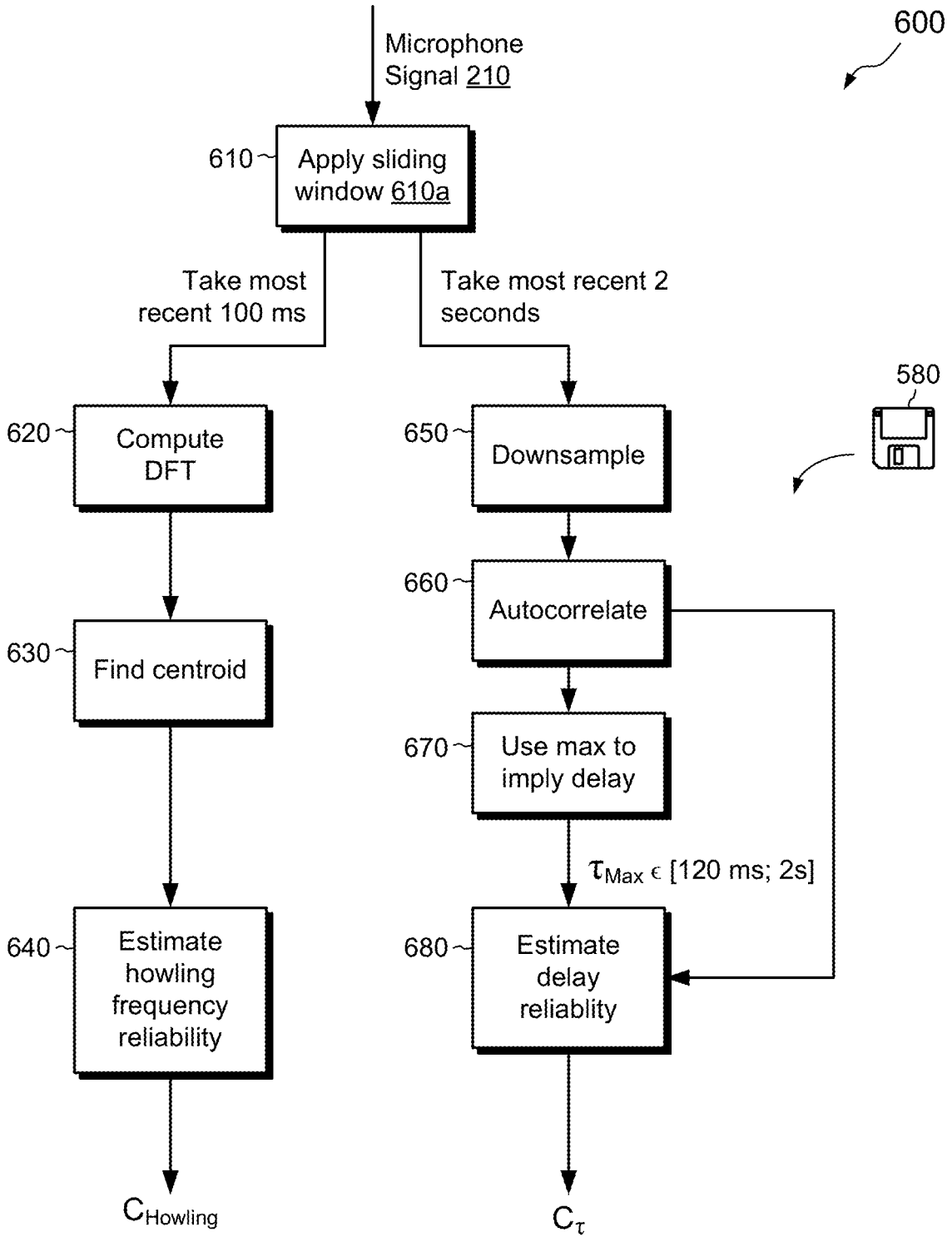
FIG. 6 is a flow chart showing another example method of detecting howling frequencies.

FIG. 6 shows an alternative method 600 for detecting howling frequencies based on the microphone signal 210 (FIG. 2). The method 600 may be performed, for example, by the signal processor 132.

At 610, a sliding time window 610*a* is applied to the microphone signal 210. The sliding window 610*a* may have a width of about two seconds, for example, which is sufficiently long to encompass any expected round-trip network delays. In an example, the sliding window 610*a* is implemented using a buffer that holds a predetermined number of most recently acquired samples of the microphone signal 210. As shown, method 600 applies the sliding window 610*a* via left and right processing paths. In an example, the left and right processing paths are each repeated approximately every 100 milliseconds.

Turning first to the left path, the depicted actions 620, 630, and 640 operate to yield a confidence score, $C_{Howling}$, which ranges from zero to one, for example, and which indicates a degree of confidence that a howling frequency has been detected.

At 620, a DFT (or other frequency transform) is computed from the windowed microphone signal 610*a*, e.g., using the most recent 100 ms or so of the buffer. At 630, the method 600 computes a centroid frequency, $f_C$, from the DFT computed at 620. In an example, the centroid frequency $f_C$ is a weighted average of magnitudes of the frequency bins of the DFT, with higher magnitudes contributing proportionally more and lower magnitudes contributing proportionally less. For example, $$f_c = \frac{\sum_{i=0}^{N-1}(f_i * |Y(f_i)|)}{\sum_{i=0}^{N} y(f_i)}, \quad \text{EQ. 6}$$

where "N" is the number of bins in the DFT, "i" is the bin index, and $|Y(f_i)|$ is the magnitude of the DFT at bin i. If the windowed microphone signal contains a howling frequency, that howling frequency is typically at the centroid frequency, $f_C$, as howling frequencies tend to predominate the power spectra in which they are found. In some examples, the range of bins over which the centroid is computed may be limited for purposes of computational efficiency. For example, rather than the summations extending from 1 to N, they may instead extend over only a subset of interest of that range, such as an interval above a certain threshold.

One should appreciate that act 630 can determine the centroid frequency, $f_C$, with a very high level of precision, which may exceed the frequency resolution of the DFT itself. For example, the act of averaging magnitude values can identify $f_C$ at frequencies that fall between adjacent DFT bins. Having such precise knowledge of the centroid frequency, and thus of the howling frequency (assuming howling is present) allows for very selective remediation of howling frequencies using narrow-band, accurately placed notch filters. It also tends to level out measurement uncertainties and random errors.

At 640, method 600 generates the confidence score $C_{Howling}$, based on the centroid frequency, $f_C$. For example, method 600 divides the magnitude of the DFT bin at the centroid frequency by the sum of magnitudes of all DFT bins, as follows:

$$C_{howling} = \frac{|Y(f_c)|}{\sum_{i=0}^{N-1}|Y(f_i)|}. \quad \text{EQ. 7}$$

In some examples, the numerator in the fraction above may be replaced with a sum of magnitudes of the DFT bins in the immediate vicinity of $f_C$, such as in the immediately surrounding one, two, three, four, or five bins on either side. The resulting confidence score $C_{Howling}$ thus represents a percentage of total power of the DFT which is present at or immediately around the centroid frequency, $f_C$. A high value of $C_{Howling}$ indicates highly concentrated power, as one would expect in the presence of howling, whereas a low value represents more distributed power, as one would expect for speech and other natural sounds.

Turning now to the path shown to the right, the depicted actions 650, 660, 670, and 680 yield another confidence score, $C_\tau$, which also ranges from zero to one, for example, and which indicates a degree of confidence in round-trip delay as implied by the windowed microphone signal 610*a*.

At 650, method 600 downsamples the windowed microphone signal 610, e.g., by keeping every D-th sample in the two-second buffer ("D" being a positive integer greater than one) and discarding the rest. The act 650 should be regarded as optional, but it goes a long way toward reducing computational complexity. For example, an audio signal sampled at 44 kHz can be downsampled by a factor of D=44 and still provide samples that are spaced apart by only one millisecond, which is a very high level of precision for purposes of measuring network delay.

At 660, method 600 performs an autocorrelation operation on the downsampled version of the windowed microphone signal 610*a*. Autocorrelation may proceed substantially as described above in connection with FIG. 4, by providing an autocorrelation window that is advanced forward in time, as was the autocorrelation window 430 used in EQ. 2. In a particular example, act 660 computes an autocorrelation function by taking a DFT of the downsampled signal, i.e., using known techniques to compute autocorrelation from a DFT. The result of act 660 is a set of autocorrelation values, e.g., one value per sample of the downsampled signal, where each value represents autocorrelation at a respective delay value. One should appreciate that the autocorrelation results obtained by act 660 require only a single DFT.

At 670, method 600 identifies the delay value at which the maximum value of autocorrelation is found. For example, act 670 identifies a maximum autocorrelation value and references its corresponding time value. This time value, $\hat{\tau}_{Max}$, directly implies the round-trip network delay value, which is given as $\tau_{Max}=D*\hat{\tau}_{Max}$, where D is the subsampling factor. This time value $\tau_{Max}$ may be determined to a high level of precision, given that adjacent values of the autocorrelation function may be separated by one millisecond or less.

In an example, act 670 imposes limits on the value of $\tau_{Max}$, e.g., by requiring such values to fall within an expected range, such as between 120 ms and 2 s. Any values of $\sigma_{Max}$ falling outside this range may be discarded.

At 680, method 600 generates the confidence score $C_\tau$ based on the autocorrelation results. In an example, the methodology used to generate $C_\tau$ may be similar to that used for computing linear prediction coefficients (LPC). In a particular example, $C_\tau$ is expressed as follows:

$$C_\tau = \frac{\gamma(\hat{\tau}_{Max})}{\gamma(0)}, \qquad \text{EQ. 8}$$

where $\gamma(\hat{\tau}_{Max})$ is the autocorrelation value at time value $\hat{\tau}_{Max}$ and $\gamma(0)$ is the autocorrelation value at time zero. Confidence score $C_\tau$ can thus be regarded as the fraction of an original pattern that can be found in a repeated version of that pattern. A high value of $C_\tau$ indicates high confidence that the measured delay $\tau_{Max}$ is indeed the true network delay, whereas a low value of $C_\tau$ indicates the opposite. If confidence $C_\tau$ is high (e.g., if it exceeds a predetermined threshold), then $\tau_{Max}$ may be taken as an accurate measure of round-trip delay and may be applied as real-time delay 262 (FIG. 2) when compensating for variable network delays.

In an example, one can use confidence scores $C_{Howling}$ and $C_\tau$ together to effectively identify howling frequencies. For example, high levels of both confidence scores strongly suggest the presence of howling frequencies, whereas a high level of one but not the other is less conclusive and low levels of both may confirm their absence. In an example, each of the confidence scores is compared with a respective threshold and evaluated in a binary fashion, either as high or low, depending on whether that score is above or below its respective threshold.

Figure 7:
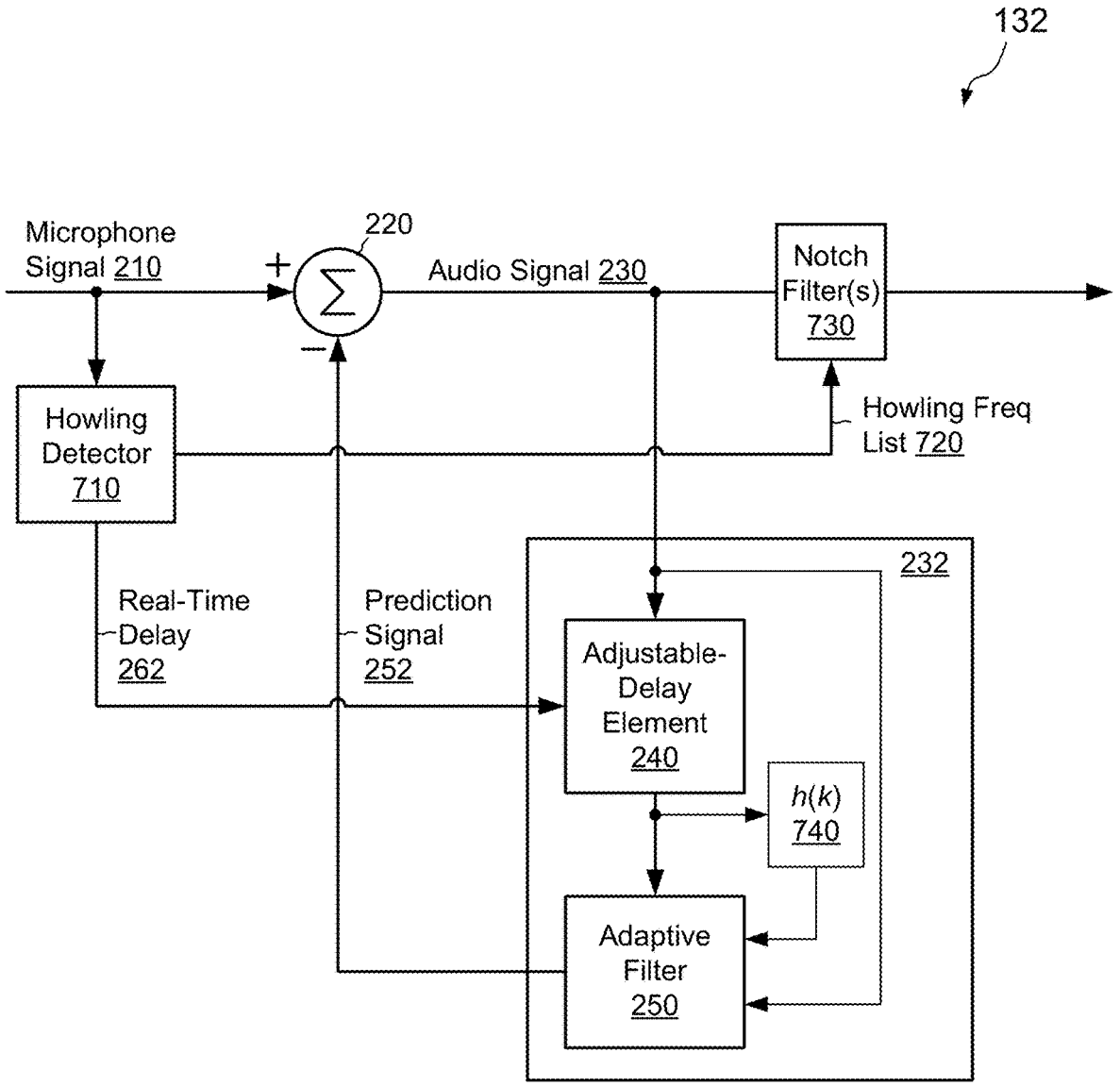
FIG. 7 is a block diagram showing a second example signal processor in additional detail.

FIG. 7 shows a more specialized embodiment of the signal processor 132, which was shown in more generalized form in FIG. 2. In FIG. 7, the delay measurement unit 260 of FIG. 2 has been implemented using a howling detector 710. The howling detector 710 may employ the method 500 to identify a list 720 of howling frequencies. The howling detector 710 may further employ any of the arrangements of FIGS. 4-6 to measure round-trip delay, or variations in such delay, which the howling detector 710 may use to establish values of real-time delay 262.

To reduce or eliminate the detected howling frequencies, the signal processor 132 may implement a set of notch filters 730. For example, a single notch filter may be provided with multiple stop bands (frequency notches), one for each howling frequency. Alternatively, multiple notch filters may be cascaded, each having a single stop band (e.g., for a single howling frequency) or any number of stop bands. In an example, the notch filter(s) 730 serve not only to reduce the unpleasant effects of howling, but also to linearize the feedback loop, as howling frequencies can introduce nonlinearities in the form of clipping or other distortion.

In some examples, the path emulator 232 includes a decorrelation filter 740. As is known, decorrelation filters can help to improve the speed of convergence of the adaptive filter 250. In a simple example, the decorrelation filter 740 is implemented with one tap with a one, i.e., not as an active filter.

Figure 8:
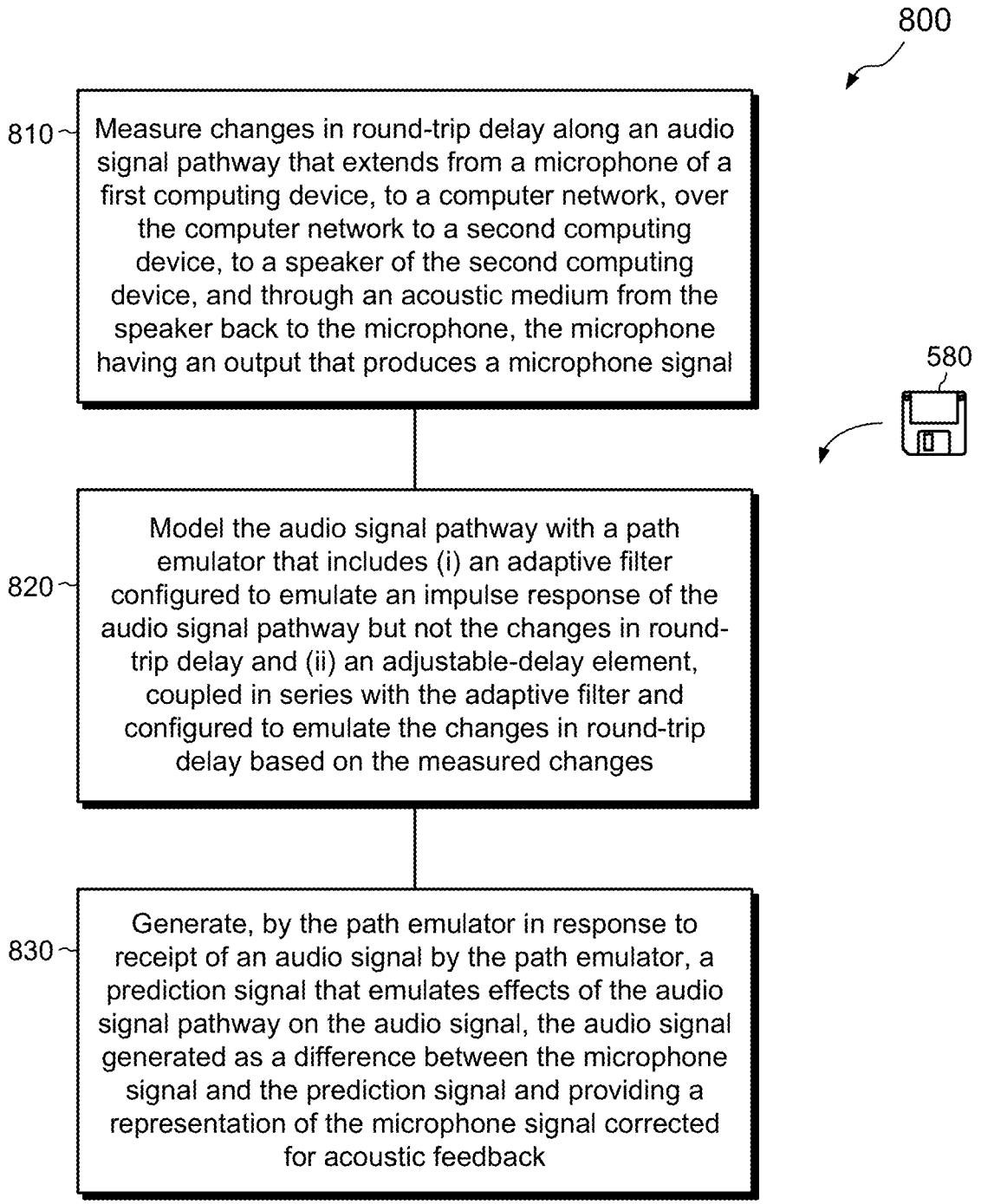
FIG. 8 is a flowchart showing an example method of reducing acoustic feedback in audio communications.

FIG. 8 shows an example method 800 that may be carried out in connection with the environment 100. The method 800 is typically performed, for example, by the software constructs described in connection with FIG. 1, which reside in the memory 130*a* of the computing device 120*a* and are run by the set of processors 124*a*. The various acts of method 800 may be ordered in any suitable way. Accordingly, embodiments may be constructed in which acts are performed in orders different from that illustrated, which may include performing some acts simultaneously.

At 810, changes are measured in round-trip delay along an audio signal pathway 160 that extends from a microphone 150*a* of a first computing device 120*a*, to a computer network 104, over the computer network 104 to a second computing device 120*b*, to a speaker 140*b* of the second computing device 120*b*, and through an acoustic medium 170 from the speaker 140*b* back to the microphone 150*a*, the microphone having an output that produces a microphone signal 210.

At 820, the audio signal pathway is modeled with a path emulator 232 that includes (i) an adaptive filter 250 configured to emulate an impulse response of the audio signal pathway 160 but not the changes in round-trip delay and (ii) an adjustable-delay element 240, coupled in series with the adaptive filter 250 and configured to emulate the changes in round-trip delay based on the measured changes.

At 830, the path emulator 232 generates, in response to receipt of an audio signal 230 by the path emulator 232, a prediction signal 252 that emulates effects of the audio signal pathway 160 on the audio signal 230. The audio signal is generated as a difference between the microphone signal 210 and the prediction signal 252 and provides a representation of the microphone signal 210 corrected for acoustic feedback Having described certain embodiments, numerous alternative embodiments or variations can be made. For example, although the path emulator 252 is shown and described as residing within the computing device 120*a*, it may alternatively be located elsewhere, such as in the conference server 106. Further, although notch filter(s) 630 are shown within the signal processor 132, they may alternatively be located anywhere in the pathway 160. Further still, although the frequency transform has been described herein as a discrete Fourier transform (DFT), other frequency transforms may alternatively be used, such as discrete sine transforms, discrete cosine transforms, and the like.

Further, although features are shown and described with reference to particular embodiments hereof, such features may be included and hereby are included in any of the disclosed embodiments and their variants. Thus, it is understood that features disclosed in connection with any embodiment are included as variants of any other embodiment.

Further still, the improvement or portions thereof may be embodied as a computer program product including one or more non-transient, computer-readable storage media, such as a magnetic disk, magnetic tape, compact disk, DVD, optical disk, flash drive, solid state drive, SD (Secure Digital) chip or device, Application Specific Integrated Circuit (ASIC), Field Programmable Gate Array (FPGA), and/or the like (shown by way of example as medium 580 in FIGS. 5, 6 and 8). Any number of computer-readable media may be used. The media may be encoded with instructions which, when executed on one or more computers or other processors, perform the process or processes described herein. Such media may be considered articles of manufacture or machines, and may be transportable from one machine to another.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Further, although ordinal expressions, such as "first," "second," "third," and so on, may be used as adjectives herein, such ordinal expressions are used for identification purposes and, unless specifically indicated, are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Although certain embodiments are disclosed herein, it is understood that these are provided by way of example only and that the invention is not limited to these particular embodiments.

Those skilled in the art will therefore understand that various changes in form and detail may be made to the embodiments disclosed herein without departing from the scope of the invention.

What is claimed is:

1. A method of reducing acoustic feedback in audio communications, the method comprising:

measuring changes in round-trip delay along an audio signal pathway that extends from a microphone of a first computing device, to a computer network, over the computer network to a second computing device, to a speaker of the second computing device, and through an acoustic medium from the speaker back to the microphone, the microphone having an output that produces a microphone signal;

modeling the audio signal pathway with a path emulator that includes (i) an adaptive filter configured to emulate an impulse response of the audio signal pathway but not the changes in round-trip delay and (ii) an adjustable-delay element, coupled in series with the adaptive filter and configured to emulate the changes in round-trip delay based on the measured changes; and generating, by the path emulator in response to receipt of an audio signal by the path emulator, a prediction signal that emulates effects of the audio signal pathway on the audio signal, the audio signal generated as a difference between the microphone signal and the prediction signal and providing a representation of the microphone signal corrected for acoustic feedback.

2. The method of claim 1, wherein measuring the changes in round-trip delay includes measuring multiple instances of round-trip delay at respective times, and wherein modeling the audio signal pathway includes configuring, in real time, the adjustable-delay element to establish delay changes that match the measured changes in round-trip delay.

3. The method of claim 2, wherein measuring each instance of round-trip delay includes:

identifying a repeating pattern in the microphone signal; and generating the instance of round-trip delay as a time difference between a first occurrence of the repeating pattern and a second occurrence of the repeating pattern.

4. The method of claim 3, wherein identifying the repeating pattern includes detecting a set of howling frequencies in the microphone signal, each howling frequency being a frequency at which the microphone signal exhibits unstable oscillatory behavior.

5. The method of claim 4, wherein generating the instance of round-trip delay includes:

generating multiple frequency transforms of the microphone signal at respective times;

performing an autocorrelation operation on a selected frequency bin across the frequency transforms, the autocorrelation operation providing a measure of correlation among magnitudes of the selected frequency bin over time; and identifying the instance of round-trip delay as a time at which the autocorrelation operation produces a maximum value, wherein generating the instance of round-trip delay is based at least in part on measurements of at least one of the set of howling frequencies.

6. The method of claim 5, wherein configuring, in real time, the adjustable delay element includes establishing a delay setting of the delay element based at least in part on the identified instance of round-trip delay.

7. The method of claim 5, wherein detecting the set of howling frequencies includes:

identifying multiple sets of frequency bins across the frequency transforms, each set of frequency bins corresponding to a respective frequency range, different sets of frequency bins corresponding to different frequency ranges; and for each set of frequency bins, performing a power test on that set of frequency bins, the power test passing in response to a peak-to-average power ratio (PAPR) of the set of frequency bins exceeding a predetermined PAPR threshold, the power test failing in response to the PAPR of the set of frequency bins falling below the predetermined PAPR threshold.

8. The method of claim 7, further comprising disqualifying frequency bins as candidates for containing a howling frequency in response to the power test failing.

9. The method of claim 7, wherein detecting the set of howling frequencies further includes, for each set of frequency bins for which the power test passes, performing an autocorrelation test on that set of frequency bins, the autocorrelation test passing in response to an autocorrelation operation performed on the set of frequency bins producing a maximum value that exceeds a predetermined autocorrelation threshold, the autocorrelation test failing in response to the autocorrelation operation performed on the set of frequency bins producing a maximum value that falls below the predetermined autocorrelation threshold; and detecting a howling frequency in the frequency range that corresponds to the set of frequency bins, in response to both the power test passing and the autocorrelation test passing.

10. The method of claim 4, further comprising, once the set of howling frequencies has been detected, implementing a set of notch filters in line with the audio signal pathway, the set of notch filters configured to selectively attenuate the set of howling frequencies.

11. The method of claim 2, further comprising realizing the path emulator entirely within the first computing device.

12. The method of claim 1, further comprising:

generating a frequency transform of the microphone signal;

generating an autocorrelation function of the microphone signal; and identifying a set of howling frequencies based on both the frequency transform and the autocorrelation function.

13. The method of claim 12, further comprising:

generating a centroid frequency that represents a weighted average of magnitude values of the frequency transform;

computing a sum of magnitude values of frequency bins within a predetermined range of the centroid frequency; and confirming the centroid frequency as a howling frequency based at least in part on a ratio of the sum of magnitude values to a sum of all magnitude values of the frequency transform exceeding a predetermined threshold.

14. The method of claim 12, further comprising:

generating multiple frequency transforms of the microphone signal at respective times;

identifying multiple sets of frequency bins across the frequency transforms, each set of frequency bins corresponding to a respective frequency range, different sets of frequency bins corresponding to different frequency ranges; and for each set of frequency bins, performing a power test on that set of frequency bins, the power test passing in response to a peak-to-average power ratio (PAPR) of the set of frequency bins exceeding a predetermined PAPR threshold, the power test failing in response to the PAPR of the set of frequency bins falling below the predetermined PAPR threshold.

15. The method of claim 12, further comprising, once the set of howling frequencies has been identified, implementing a set of notch filters in line with the audio signal pathway, the set of notch filters configured to selectively attenuate the set of howling frequencies.

16. A computerized apparatus, comprising control circuitry that includes a set of processors coupled to memory, the control circuitry constructed and arranged to:

measure changes in round-trip delay along an audio signal pathway that extends from a microphone of a first computing device, to a computer network, over the computer network to a second computing device, to a speaker of the second computing device, and through an acoustic medium from the speaker back to the microphone, the microphone having an output that produces a microphone signal;

model the audio signal pathway with a path emulator that includes (i) an adaptive filter configured to emulate an impulse response of the audio signal pathway but not the changes in round-trip delay and (ii) an adjustable-delay element, coupled in series with the adaptive filter and configured to emulate the changes in round-trip delay based on the measured changes; and generate, by the path emulator in response to receipt of an audio signal by the path emulator, a prediction signal that emulates effects of the audio signal pathway on the audio signal, the audio signal generated as a difference between the microphone signal and the prediction signal and providing a representation of the microphone signal corrected for acoustic feedback.

17. A computer program product including a set of non-transitory, computer-readable media having instructions which, when executed by control circuitry of a computerized apparatus, cause the computerized apparatus to perform a method for reducing acoustic feedback in audio communications, the method comprising:

measuring changes in round-trip delay along an audio signal pathway that extends from a microphone of a first computing device, to a computer network, over the computer network to a second computing device, to a speaker of the second computing device, and through an acoustic medium from the speaker back to the microphone, the microphone having an output that produces a microphone signal;

modeling the audio signal pathway with a path emulator that includes (i) an adaptive filter configured to emulate an impulse response of the audio signal pathway but not the changes in round-trip delay and (ii) an adjustable-delay element, coupled in series with the adaptive filter and configured to emulate the changes in round-trip delay based on the measured changes; and generating, by the path emulator in response to receipt of an audio signal by the path emulator, a prediction signal that emulates effects of the audio signal pathway on the audio signal, the audio signal generated as a difference between the microphone signal and the prediction signal and providing a representation of the microphone signal corrected for acoustic feedback.

18. The computer program product of claim 17, wherein measuring the changes in round-trip delay includes measuring multiple instances of round-trip delay at respective times, and wherein modeling the audio signal pathway includes configuring, in real time, the adjustable-delay element to establish delay changes that match the measured changes in round-trip delay, and wherein measuring each instance of round-trip delay includes (i) identifying a repeating pattern in the microphone signal and (ii) generating the instance of round-trip delay as a time difference between a first occurrence of the repeating pattern and a second occurrence of the repeating pattern.

19. The computer program product of claim 18, wherein identifying the repeating pattern includes detecting a set of howling frequencies in the microphone signal, each howling frequency being a frequency at which the microphone signal exhibits unstable oscillatory behavior, and wherein generating the instance of round-trip delay is based at least in part on measurements of at least one of the set of howling frequencies.

* * * * *